United States Patent [19]

Bellerose

[11] 4,085,631

[45] Apr. 25, 1978

[54] CANNON PLUG WRENCH

[76] Inventor: Gerard D. Bellerose, 94-820 Awanei St. #8, Waipahu, Hi. 96797

[21] Appl. No.: 780,721

[22] Filed: Mar. 24, 1977

[51] Int. Cl.[2] ..... B25B 13/48

[52] U.S. Cl. ..... 81/3 R; 81/90 C; 81/120

[58] Field of Search ..... 81/3 R, 90 B, 90 C, 81/120, 121 B

[56] References Cited

U.S. PATENT DOCUMENTS

| | | | |
|---|---|---|---|
| D. 53,597 | 7/1919 | Marcmann | 81/121 B X |
| D. 194,708 | 2/1963 | Fink | 81/120 X |
| 1,811,137 | 6/1931 | Kress | 81/121 B |

*Primary Examiner*—Al Lawrence Smith
*Assistant Examiner*—James G. Smith
*Attorney, Agent, or Firm*—Joseph E. Rusz; Willard R. Matthews, Jr.

[57] ABSTRACT

A tool that permits assembly and disassembly of a variety of cannon plugs without the risk of plug damage commonly caused by pliers and other conventional assembly equipment. It comprises a multiplicity of differently sized Cannon plug holding members mounted on a wrench type fixture. A key and keyway arrangement prevents the plugs from turning while backshell and saddle clamps are attached or removed.

1 Claim, 3 Drawing Figures

CANNON PLUG WRENCH

STATEMENT OF GOVERNMENT INTEREST

The invention described herein may be manufactured and used by or for the Government for governmental purposes without the payment of any royalty thereon.

BACKGROUND OF THE INVENTION

This invention relates to electrical plug assembly apparatus, and in particular to means for attaching and removing backshell and saddle clamps from certain Cannon plugs.

The electrical industry utilizes, in great quantity, electrical plugs manufactured by Cannon Electric, Inc. of 3208 Humboldt Street, Los Angeles, Calif. These plugs, and in particular those designated as general circuiting and MS type plugs, include backshell and saddle clamps. Utilization of these plugs requires the tightening and loosening of the clamps. It has been common practice to grip the lower portion of the plug with pliers or the like in order to hold the device during the clamp loosening and tightening processes. This frequently results in damage to the plug and its connections. There exists the need, therefore, for a tool that is capable of holding any standard common plug during assembly and disassembly procedures. Such a tool should be easy to use and should perform its function without damage to the plug or its electrical connections. The present invention is directed toward providing such a tool.

SUMMARY OF THE INVENTION

The invention is a special tool for accomplishing the assembly and disassembly of cannon type electrical plugs without inflicting the type of damage to parts that often results when ordinary tool such as pliers are used. The tool is a form of wrench having a substantially circular plate member to which is attached an extension member in the form of a handle to be grasped. Spaced around the outer edge of the plate member and attached thereto are a multiplicity of receptacles that accommodate various standard cannon plug bases. An additional receptacle is attached to the center of the plate. An outer, substantially crescent shaped plate member is attached along its inner curved edge to each of the receptacles. Operation requires matching the plag to be assembled or disassembled with its corresponding receptacle and then unscrewing the parts by using a standard tool such as pliers.

It is a principal object of the invention to provide a new and improved tool for use in the assembly and disassembly of Cannon electrical plugs.

It is another object of the invention to provide a Cannon plug holding tool that is easy and convenient to use and that does not damage the plug or its electrical connections.

These, together with other objects, features and advantages of the invention, will become more apparent from the following detailed description when taken in conjunction with the illustrated embodiment of the accompanying drawings.

DESCRIPTION OF THE PREFERRED EMBODIMENT

Figure 1:
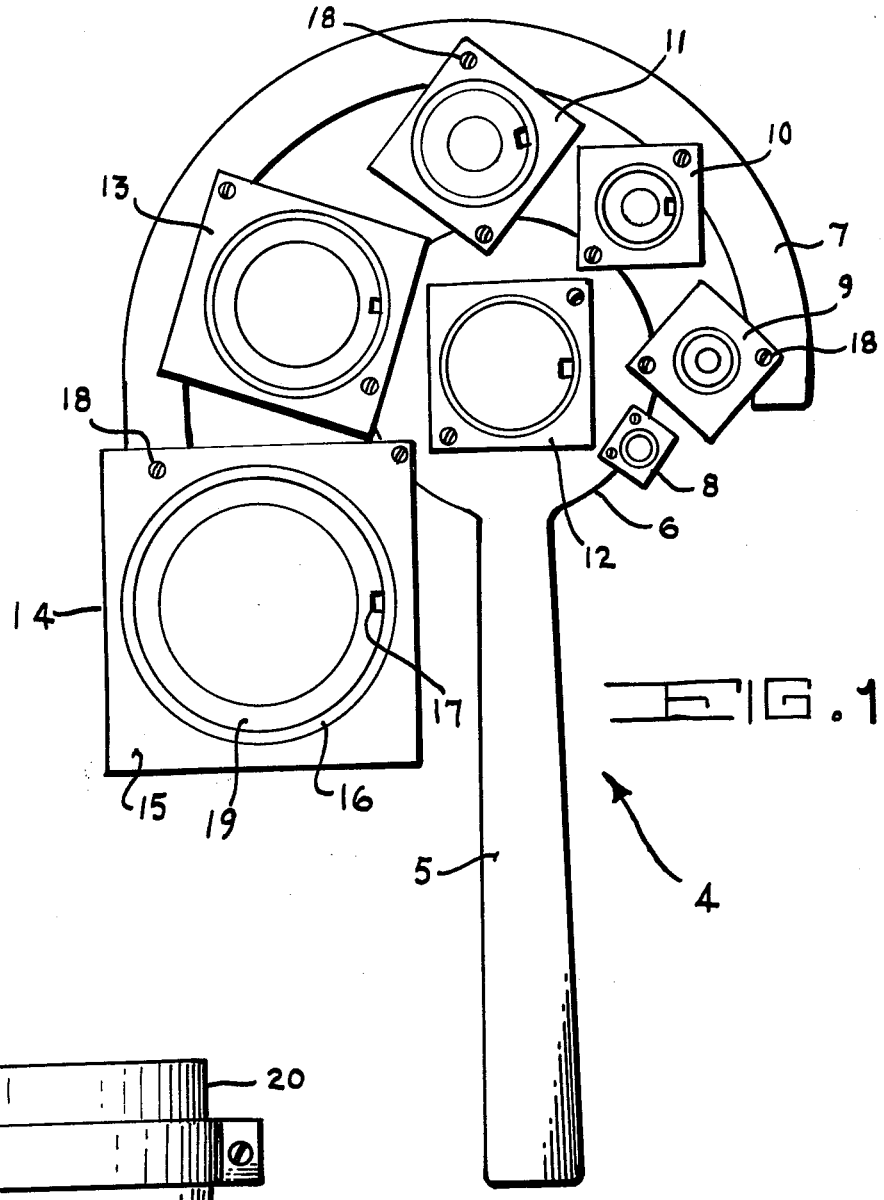
FIG. 1 is a plan view of one presently preferred embodiment of the invention.
Figure 2:
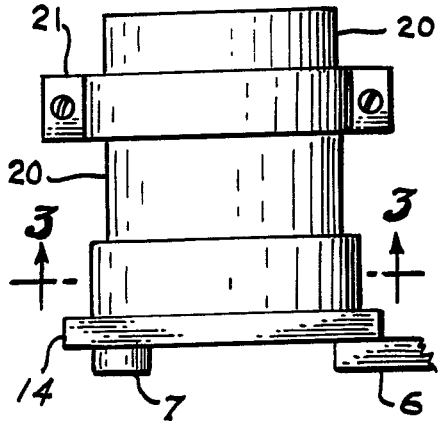
FIG. 2 is a view, in elevation, of one plug receptacle of the device of FIG. 1 with a Cannon plug in place.
Figure 3:
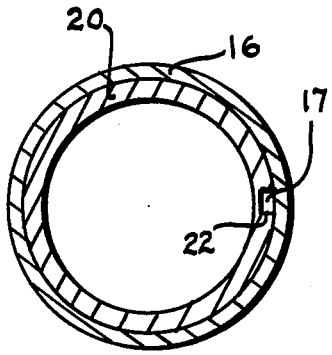
FIG. 3 is a sectional view of the Cannon plug at FIG. 2 taken at 3—3.

Referring now to the three figures of the drawings, the Cannon plug wrench 4 of the invention comprises circular plate member 6, handle 5, socket type receptacles 8, 9, 10, 11, 12, 13 and 14, and crescent-shaped support member 7. Each socket type receptacle consists of a base plate member 15 and a short segment cylindrical member 16. Cylindrical member 16 is perpendicularly mounted on base plate member 15 and has an inner diameter that mates with the outer diameter of the base of a given Cannon plug. Each socket type receptacle is of a different size and accommodates a different one of the various standard Cannon plugs. The center portion of base plate 15 can be removed as shown to provide a collar 19 suitable for seating the Cannon plug. The several socket type receptacles can be mounted on the device by Phillips head screws 18 or by any other structurally sound means. FIGS. 2 and 3 show a Cannon plug 20 in place in one socket type receptacle. Saddle clamp 21 can be removed by means of pliers or a wrench when the plug is in place. Twisting or turning of the plug within the Cannon plug wrench is prevented by means of protrusion 17 on the inner surface of cylindrical member 16 and keyway 22 on the base of Cannon plug 20. Alternatively, keyways could be placed in both the plug and the receptacle and an approximate key inserted to prevent turning of the plug.

While the invention has been described in one presently preferred embodiment of the invention, it is understood that the words which have been used are words of description rather than words of limitation and that changes within the purview of the appended claims may be made without departing from the scope and spirit of the invention in its broader aspects.

What is claimed is:

1. A Cannon plug wrench comprising a handle, a circular plate member affixed to one end thereof, a crescent shaped support member, a Cannon plugholding member mounted on said circular plate member, and a multiplicity of Cannon plug holding members mounted between said circular plate member and said crescent shaped support member, each Cannon plug holding member being of a different size and adapted to accommodate a different discrete Cannon plug, each said Cannon plug holding member comprising a base plate member and a short segment hollow cylindrical member perpendicularly mounted thereon, the inner diameter thereof being substantially equal to the outer diameter of the base portion of a given Cannon plug and having a protruding key ridge thereon, said key ridge being configured and oriented to mate with a keyway in the base of said Cannon plug.

* * * * *